United States Patent [19]

Thalenfeld

[11] 4,025,018

[45] May 24, 1977

[54] PROTECTIVE TIP FOR PANEL BOARD HOOKS AND THE LIKE

[76] Inventor: David R. Thalenfeld, 39 Water Mill Lane, Great Neck, N.Y. 11021

[22] Filed: Sept. 15, 1975

[21] Appl. No.: 613,227

[52] U.S. Cl. ..... 248/303; 211/59.1; 248/221.2

[51] Int. Cl.[2] ..... A47F 7/00

[58] Field of Search ..... 248/303, DIG. 3, 304, 248/206 R, 188.9; 211/54, 57, 59

[56] References Cited

UNITED STATES PATENTS

| | | | |
|---|---|---|---|
| 938,504 | 11/1909 | Nodine | 248/24 |
| 2,116,369 | 5/1938 | Stolp | 211/54 UX |
| 2,432,719 | 12/1947 | Braun | 248/206 R |
| 2,744,283 | 5/1956 | Reineman | 248/188.9 UX |
| 3,199,819 | 8/1965 | Widmark | 248/188.9 |
| 3,897,926 | 8/1975 | Silver | 248/DIG. 3 X |

*Primary Examiner*—J. Franklin Foss
*Attorney, Agent, or Firm*—Mandeville and Schweitzer

[57] ABSTRACT

The disclosure is directed to a protective tip for panel board hooks and the like. The tip is formed of a soft plastic material, of a highly visible color. It forms an extension of the end of the panel board hook, providing a yieldable extremity. The tip is formed with an internal shoulder for reliable positioning and is frictionally retained on the end of the display hook. It is of a thin walled, generally cylindrical configuration to accommodate placement and removal of carded merchandise of conventional form, and is provided with a tapered inner extremity for minimum interference with merchandise removal. Advantageously, the tip is produced by dipping of a mandrel preform into a liquid body of plastic for a controlled interval.

5 Claims, 3 Drawing Figures

PROTECTIVE TIP FOR PANEL BOARD HOOKS AND THE LIKE

BACKGROUND AND SUMMARY OF THE INVENTION

In connection with point-of-purchase merchandise display, it is a common and widespread practice to utilize display arrangements including perforated panel boards on which are mounted a plurality of display hooks. The display hooks typically have lugs received in the panel board openings and have outwardly extending hanger sections formed of rigid wire. The wire hanger sections extend generally straight out from the panel board and are provided at the outer end extremity with a slightly upturned end portion. Display merchandise in the form of bags or cards, provided with an opening in the top or header portion, can be received over the end of the wire hanger and hung for display. The display articles may then be removed one at a time by being withdrawn outwardly over the slightly upturned end of the hook. An advantageous form of such display hook is represented by, for example, U.S. Pat. No. 3,289,993. However, the present invention is directed generally to various types and styles of wire display hooks, as will become apparent.

Experience has shown that, under certain circumstances, the outwardly extending tip extremity of a wire display hook may constitute a safety hazard. For example, in a case where a relatively long wire hanger, which is located in a poorly lit area, is exhausted or nearly so of its merchandise and is near the walking areas used by customers and/or store personnel, it may be possible for a person to have accidental contact with the exposed tip of the hanger. Such contact could result in potentially serious injury, in cases where the hangers are located near eye level, as is often the case. It has been proposed heretofore to minimize the likelihood of injury from such display hooks, as by forming a round ball at the end extremity of the hook, or by placing a plastic or other smooth protector over the end of the hook. While such arrangements do constitute an improvement, they still fall short of the desired level of safety, because of the inherent rigidity of the hook. Even where a smooth cover is utilized, the covered portion of the hook retains its basic rigidity, capable of causing serious injury to soft eye tissue, for example.

In accordance with the present invention, a novel and improved form of resilient protective tip for display hooks is provided, which can be manufactured and utilized at an extremely small increment of cost and yet which affords a remarkably superior level of safety protection as compared to equipment heretofore available for the purpose. In this respect, the protective tip element of the invention, in addition to being formed of a soft, yieldable material, is formed to provide a substantial length of hollow, tip extremity, unsupported by the rigid wire of the hanger, and which will readily yield if contacted.

In accordance with one of the significant features of the invention, the outstanding safety aspects of the invention are realizable in a protective tip element which is capable of easy and inexpensive application to display board hooks of existing design and construction. In this respect, it will be understood that hundreds of millions of such hooks have been sold and are in regular use, such that complete replacement of existing hooks is a highly undesirable alternative. The device of the present invention, on the other hand, can be quickly and easily put in place by unskilled workers, so that the conversion of existing hooks to incorporate the protective feature is economically realistic and practical.

The protective tip of the invention is of hollow, generally cylindrical form, made out of a soft, resilient, plastic based material, such as polyvinyl chloride. The element may be formed by dip coating on a mandrel preform, arranged to provide several significant structural features. To this end, the mandrel preform is shaped to provide an internal shoulder at about mid-length of the protective tip. This shoulder, advantageously constituting an annular restriction in the internal configuration of the tip, forms a positive stop when seated against the outer extremity of the hanger wire. Thus, the protective tip is automatically properly positioned on the display hanger, when it is pushed over the tip of the wire until seated against the internal shoulder. The dipping of the mandrel preform is also arranged to be carried out in a manner to provide that the inner or open end extremity of the hollow tip element tapers to a relatively thin annular edge at the extremity. This facilitates removal of carded and other display merchandise from the protected display hanger.

For a more complete understanding of the above and other features and advantages of the invention, reference should be made to the following detailed description of a preferred embodiment, and to the accompanying drawing.

DESCRIPTION OF A PREFERRED EMBODIMENT OF THE INVENTION

Figure 1:
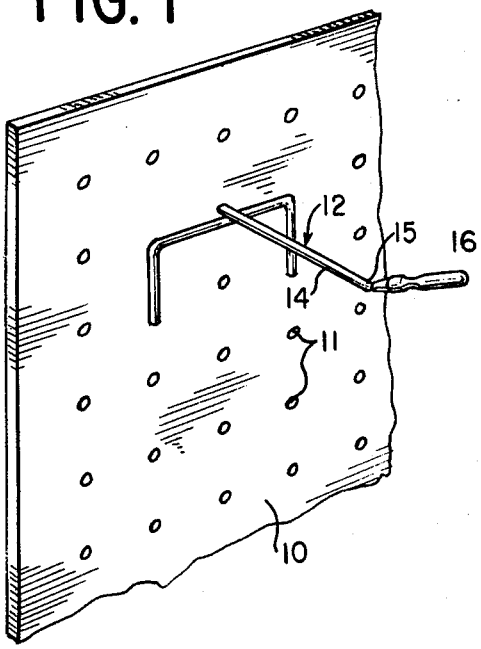
FIG. 1 is a perspective view of a panel board display arrangement, illustrating a display hook having a protective tip element according to the invention.

Referring now to the drawing, the reference numeral 10 designates a perforated panel board of a well known and conventional type, which is provided over most or all of its surface with a grid work of regularly spaced openings 11. In accordance with well known practices, a panel board display hook 12 is provided with lugs 13 of a size, shape and spacing to be received in a spaced pair of panel board openings. A typical, conventional display hanger includes an outwardly extending hanger portion 14, formed of a relatively rigid wire, which is provided at its outer end extremity with a slightly upturned portion 15. Typically, the wire hanger portion 14 may be on the order of ⅛ – 3/16 inch in diameter.

In typical use, carded merchandise, usually having a paper board or plastic header provided with a suitable opening, is applied over and suspended from the wire hanger 14 on convenient display. Individual packages are then removed from the hanger by being slid forwardly of the exposed forward end of the hanger.

As will be appreciated, the exposed end of the wire hanger can present a safety hazard, inasmuch as it projects well out in front of the panel 10. When approached end-on, the extremity of the wire can be difficult to see, particularly so if there is no merchandise near the end of the hanger, which may cause the viewer's attention to be focused away from the tip of the hanger.

Pursuant to the invention, there is provided a novel and economically practical form of tip protector which in addition to making the hook tip more readily visible and therefore more likely to be avoided, serves the important secondary function of yielding readily when contacted so that, in ordinary circumstances, injury is avoided or, at any rate, greatly minimized. As reflected particularly in FIG. 2, the tip protector, generally designated by the reference numeral 16, is of a generally hollow cylindrical form, having a closed end 17 of generally semi-spherical configuration, and an open end 18. In a typical practical application, for a display hook having a diameter on the order of one-eighth—three-sixteenth of an inch, the tip protector 16 advantageously has an overall length of about 1½ inches. As will be further described, approximately one-half of that overall length is applied over the upturned end 15 of the display hook, while the remaining one half extends in cantilever fashion beyond the end face 19 of the wire. Most typically, the wire hanger 14 will have a plain, squared-off end 19, so that the upturned end extremity 15 of the hanger is of uniform diameter throughout. However, the invention is not necessarily limited to an end configuration of that type.

The protector element 16 is, in accordance with the invention, formed of a very soft, yieldable, resilient material. A soft polyvinyl chloride, formed by a dip coating procedure, is particularly suitable for the purpose. At its open end, the body of the protector element has an internal cavity of generally cylindrical form, of a diameter normally slightly less than the minimum tolerance diameter of the specific wire size for which the protector is intended to be used. Thus, for ⅛ inch wire hooks, the internal diameter of the open end cavity might be on the order of 0.120 inch, for example. The arrangement is such that the open end of the protector body may be relatively easily applied over the upturned end portion 15 of the display hook, yielding slightly in an expanding direction, so that the tip grips and is firmly retained by the end of the wire.

Approximately midway of the length of the protector element 16, an internal shoulder 20 is formed, serving as an abutment stop when seated against the end face 19 of the hook tip 15. Desirably, the shoulder 20 is of annular form, although it could also, of course, be in the form of a plurality of angularly spaced lugs extending inward from the principal side wall outline of the tip element. In the particular form of the invention illustrated in FIG. 2, the abutment shoulder 20 is formed by a wall section 21 which extends a short distance toward the closed end of the tip element and then tapers divergently, at 22, toward the principal wall outline of the element 16.

In a practical embodiment of the invention, the shoulder 20 is located approximately three quarters of an inch from the open end 18 of the protector element defining a sleeve-like wire gripping portion 23. It is intended, in this connection, that the upturned tip portion 15 of the display hook will have an effective length equal to or, preferably, slightly exceeding the sleeve-like portion 23, so that the open end of the installed protector will not be bent or distorted around the bent area of the hook.

Pursuant to the invention, the side wall dimensions of the tip body are relatively small, in relation to the diameter of the primary internal cavity 24 at the outer end, such that, while the tip has ample rigidity to be fully self-supporting, it will readily yield when pressure is applied to it. In a particularly advantageous embodiment of a tip, designed for a wire hook of about ⅛ inch in diameter, a protective tip of about 1½ inches in length is formed to have a primary side wall thickness of about 0.045 inch. Thus, the side wall thickness is about one third of the cavity diameter. This wall thickness would also be suitable for tips of somewhat larger internal diameter, for larger diameter hooks. Typically, the shoulder abutments, whether annular or other form, may project inwardly from the principal cylindrical outline of the wall around 0.025 inch, sufficient to provide a relatively positive limit stop when the tip is applied to the end of the hanger. The length of the outer internal cavity 24 is several times the diameter of the element, as is apparent in the drawing.

To great advantage, the inner or open end of the tip body is tapered down, as indicated at 25, to a relatively sharp annular edge 26 which lies tightly against the sides of the pegboard hook. This minimizes snagging of the package header during removal of merchandise.

Economical production of the protective tip 16 is a consideration of importance as will be appreciated. To this end, the design of the new protective tip is such as to readily accommodate large scale, low cost production by dip coating processes of generally known type. For this purpose, mandrels 30 of appropriate size and shape are caused to be projected into a liquid body 31 of a suitable PVC-based liquid. The mandrel 30 acquires a surface coating of the plastic and is then removed from the liquid body, conveyed into a curing oven to cure the coating material, and caused to solidify. Thereafter, the cured material is stripped off the end of the mandrel and is in a form ready to be applied to the tip of a display hanger.

Figure 3:
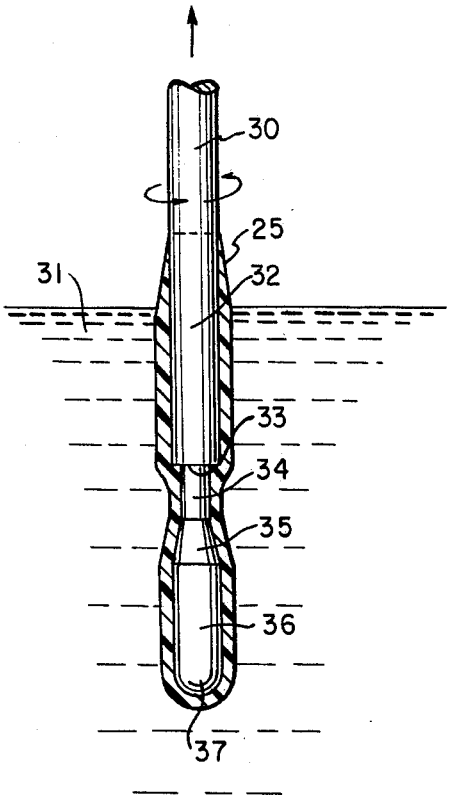
FIG. 3 is a schematic view illustrating one manner in which a protective tip according to the invention may be produced on a mandrel preform.

As reflected in FIG. 3, the mandrel 30 has a generally cylindrical shank portion 32, of a diameter calculated to produce a tip body of appropriate internal cavity diameter for a given size of display hook. The illustrated mandrel is formed with an annular shoulder 33, from which extends downwardly a short coaxial neck portion 34 of somewhat reduced diameter. The diameter of the neck portion is appropriately less than that of the shank portion 32, to define, in the finished tip element, a shoulder 20 of appropriate dimension, typically around 0.25 inch. Below the neck portion, the mandrel 32 diverges gradually in a transition area 35 and joins with a lower extremity 36, which desirably if of the same diameter as the shank 32. The lower extremity of the tip 36 is preferably rounded off to a semi-spherical configuration, as at 37.

In accordance with known dip coating practices, when the mandrel 30 is immersed in the liquid body 31 of plastic material, the plastic forms an adherent surface coating over the outer surface of the mandrel, the thickness of which is a function of the time of immersion. In general, the external contours of the adherent plastic coating will tend to follow in a general way the contours of the mandrel. The inside surface of the adherent coating, on the other hand, will precisely correspond to the exterior configuration of the mandrel.

In order to provide the desired tapered-down open end configuration of the protective tip, the mandrel 30, after it is dipped into the liquid plastic, is slowly lifted a limited distance, corresponding to the length of the tapered area 25. The upper end extremeity of the accumulating coating is thus exposed to the liquid for only a brief instant, forming a very thin coating. The regions below are in the coating for progressively longer times and will become progressively thicker, as will be understood. By appropriately controlling the rate of withdrawal of the mandrel, the desired tapered end configuration may be achieved. Once the mandrel has been controllably raised to form the tapered area 25 of desired length, and a desired wall thickness, the mandrel can be withdrawn.

Figure 2:
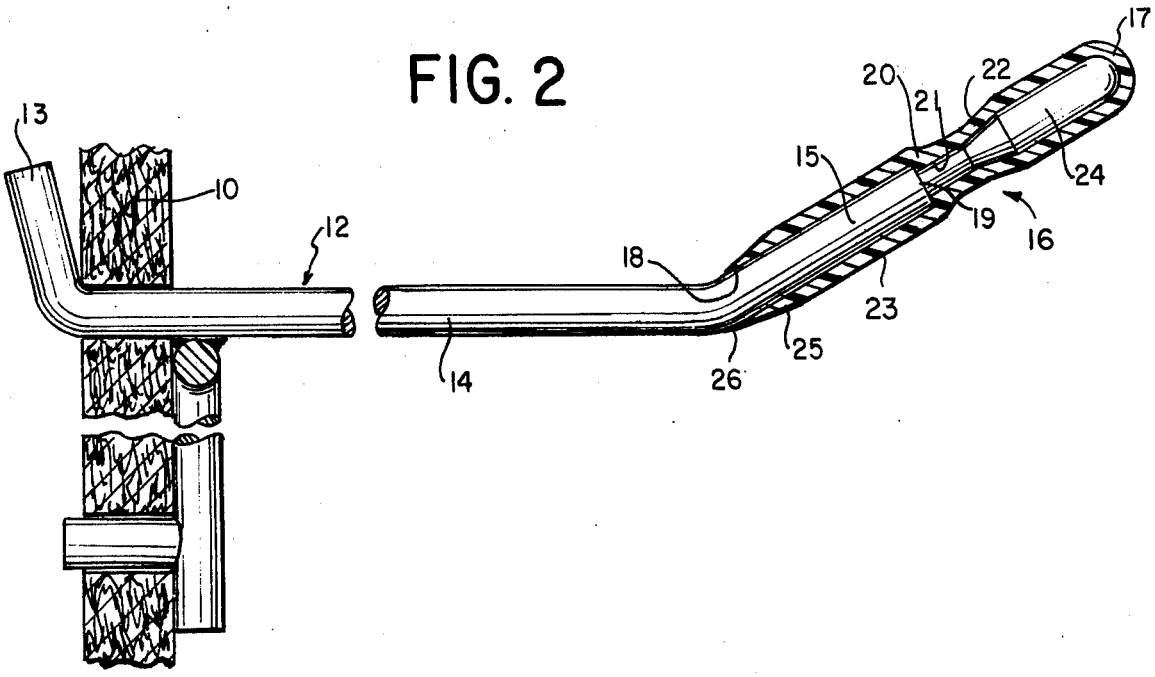
FIG. 2 is a highly enlarged, fragmentary, cross sectional view of the end portion of a typical wire display hanger having mounted thereon a protective tip constructed in accordance with the principles of the invention.

As reflected in FIG. 3, after the dipping operation has been completed, the mandrel has an adherent coating which is in the form of the desired protective tip element illustrated in FIG. 2. The mandrel is then conveyed into a curing oven, to drive off solvents and properly cure the coating into a soft, pliable, but solid material. Upon emergence of the mandrel from the curing station, the now-solidified and cured coating may be simply stripped off of the end of the mandrel and is ready to be applied to the display hook. As will be appreciated, the gradual taper provided by the transition area 35 of the mandrel facilitates stripping the shouldered area of the solidified tip from the mandrel.

The protective tip of the invention has a number of significant advantages, among which are that it may be made available at extremely low cost for application to existing stocks of display hooks. The element may be easily and quickly applied to the display hook, with the internal shoulder area providing an effectively positive stop for assuring proper positioning of the protector on the hanger tip.

An important functional feature of the new protective tip is the provision of a substantial unsupported length of hollow tip, which can readily yield upon contact and permit a person to react to the contact before serious injury is sustained. In this respect, the unsupported length of the protective tip is significantly greater than its diameter. Further, the wall thickness of this unsupported length if significantly less than its diameter. The overall configuration of the protective tip element additionally is such that it presents a minimum enlargement to the end of the display hook. Thus, the protective tip does not significantly inhibit the easy application of carded merchandise over the end of the protective tip. Likewise, particularly in view of the tapered wall configuration at the inner end, merchandise may be easily withdrawn from the protected hook.

It should be understood, of course, that the specific form of the invention herein illustrated and described is intended to be representative only, both as to the device itself and the suggested method of its manufacture, as certain changes may be made therein without departing from the clear teachings of the disclosure. Accordingly, reference should be made to the following appended claims in determining the full scope of the invention.

I claim:

1. A protective tip for a wire display hook or the like having an end portion of generally cylindrical form, which comprises a. a generally cylindrical body formed of soft, yieldable, resilient material and having an open end and a closed end, b. said body being of hollow configuration forming an internal cavity, and having a side wall thickness dimension which is substantially less than the diameter of the internal cavity, c. means forming an integral annular constriction in said cavity and defining an outwardly facing shoulder therein whereby the end face of said wire display hook will be seated against the shoulder upon placement of the body on the end portion of the hook, d. said shoulder being spaced a substantial distance from each end of said body, whereby a substantial length of hollow cavity extends between said shoulder and the closed end of said body and a substantial length of sleeve-like wire gripping wall extends between said shoulder and the open end of said body, and whereby the end face of the wire display hook will be spaced a substantial distance from the closed end of said body, thereby utilizing the substantial length of hollow cavity as a protective tip for the wire display hook, and e. said sleeve-like wall having an effective internal diameter at least slightly smaller than the diameter of said wire display hook.

2. The protective tip of claim 1, further characterized by a. said sleeve-like wall being tapered to a thin annular edge at its open end extremity.

3. The protective tip of claim 1, further characterized by a. said annular construction being shaped to form a right-angularly disposed surface, facing the open end of the body and constituting the face of said shoulder, and an annularly tapered surface diverging toward the closed end of the body.

4. A protective tip for a wire display hook or the like having a projecting end portion, which comprises a. a generally hollow, elongated body formed of a soft, yieldable resilient material and having an open end and a closed end, b. said body forming a hollow internal cavity and having a side wall thickness dimension which is substantially less than the maximum internal dimension of said internal cavity, c. means forming an integral, outwardly facing shoulder in said cavity, d. said shoulder being spaced a substantial distance from each end of said body, whereby a substantial length of hollow cavity extends between said shoulder and the closed end of said body and a substantial length of sleeve-like wire gripping wall extends between said shoulder and the open end of said body, and e. said sleeve-like wall having effective internal dimensions at least slightly smaller than the dimensions of said display hook, f. whereby when said body is placed on the projecting end portion of said wire display hook, said sleeve-like wall will grip said projecting end portion and the end face of said display hook will abut against said shoulder, thereby utilizing said length of hollow cavity as a protective tip for the wire display hook.

5. The protective tip of claim 4, further characterized by a. said body being formed of a dip-coated plastic-based material, and having its open end tapered to a relatively sharp edge extremity.

* * * * *